US005946650A

United States Patent [19]

Wei

[11] Patent Number: 5,946,650

[45] Date of Patent: Aug. 31, 1999

[54] EFFICIENT PITCH ESTIMATION METHOD

[75] Inventor: Ma Wei, Singapore, Singapore

[73] Assignee: Tritech Microelectronics, Ltd., Singapore, Singapore

[21] Appl. No.: 08/878,515

[22] Filed: Jun. 19, 1997

[51] Int. Cl.[6] ..... G10L 9/04

[52] U.S. Cl. ..... 704/207; 704/209

[58] Field of Search ..... 704/205, 207, 704/208, 209, 204

[56] References Cited

U.S. PATENT DOCUMENTS

| | | | |
|---|---|---|---|
| 4,937,873 | 6/1990 | McAulay et al. | 381/51 |
| 5,179,626 | 1/1993 | Thomson | 395/2 |
| 5,216,747 | 6/1993 | Hardwick et al. | 704/208 |
| 5,226,108 | 7/1993 | Harwick et al. | 704/200 |
| 5,495,555 | 2/1996 | Swaminathan | 704/207 |
| 5,781,880 | 7/1998 | Su | 704/207 |

OTHER PUBLICATIONS

Yang et al "Pitch Synchronous Multi–Band (PSMB) Speech Coding" Proceedings IEEE International Conf. on Acoustics, Speech & Signal Processing, ICASSP '95 p.516–9, 1995.

Griffin et al. "Multiband Excitation Vocoder" Transaction on Acoustics, Speech & Signal Processing, vol. 36, No. 8, Aug. 1988, p. 1223–35.

Hardwick et al. "A 4.8 Klops Multi Band Excitation Speech Coder" Proceedings IEEE International Conf. on Acoustics Speech, & Signal Processing, ICASSP '88 pp. 374–377, N.Y. 1988.

Griffin et al. "A New Pitch Detection Algorithm" Digital Signal Processing '84 Elsevier Science Publishers, 1984, pp. 395–399.

Griffin et al., "A New Model–Based Speech Analysis/Synthesis System" Proceedings IEEE International Conf. on Acoustics, Speech & Signal Processing ICASSP '85, 1985 pp. 513–516.

McAulay et al, "Computationally Efficient She Wave Synthesis And It's Application to Snusoidal Transform Coding" Proceedings IEEE International Conf on Acoustics, Speech and Signal Processing, ICASSP '88, pp. 370–311, 1988.

Qian et al, "A Variable Frame Pitch Estimator & Test Results" Proceedings IEEE International Conf. on Acoustics, Speech & Signal Processing ICASSP '96, pp. 228–231, 1996.

MaWei "Multiband Excitation Based Vocoders and Their Real–Time Implementation" Dissertation, Univ of Surrey, Guildford, Surrey UK, May 1994, pp. 145–150.

McAulay et al, "Mid–Rate Coding Based On A Sinusoidal Representation of Speech" Proceedings IEEE International Conf on Acoustics Speech & Signal Processing, ICASSP '85 pp. 945–948, 1985.

*Primary Examiner*—Richemond Dorvi

*Attorney, Agent, or Firm*—George O. Saile; Stephen B. Ackerman; Billy J. Knowles

[57] ABSTRACT

A method and means to estimate the pitch of a speech or acoustic signal within a vocoder begins with the center clipping and low-pass filtering of the speech or acoustic signal to eliminate the formants from the speech or acoustic signal. An error function for each pitch is calculated for each pitch within the speech or acoustic signal. A fast tracking method is used to select the estimated pitch for the pitch or acoustic signal. A final check for the doubling of the pitch will minimize any incorrect estimation of the pitch.

8 Claims, 1 Drawing Sheet

EFFICIENT PITCH ESTIMATION METHOD

RELATED PATENT APPLICATIONS

U.S. patent application Ser. No. 08/929,950, Filing Date: Sep. 15, 1997, "A Pitch Synchronized Sinusoidal Synthesizer", Assigned to the Same Assignee as the present invention.

BACKGROUND OF THE INVENTION

1. Field of the Invention

This invention relates to methods and means for the determination of the pitch of an acoustic signals within a vocoder analyzer.

2. Description of Related Art

Relevant publications include:

1. Yang et al., "Pitch Synchronous Multi-Band (PSMB) Speech Coding," *Proceedings IEEE International Conference on Acoustics, Speech, and Signal Processing* ICASSP'95, pp. 516–519, 1995 (describes a pitch-period-based speech coder);

2. Daniel W. Griffin and Jae S. Lim, "Multiband Excitation Vocoder," *Transactions on Acoustics, Speech, and Signal Processing*, Vol. 36, No. 8, August 1988, pp.1223–1235 (describes a multiband excitation model for speech where the model includes an excitation spectrum and spectral envelope);

3. John C. Hardwick and Jae S. Lim, "A 4.8 Kbps Multi-Band Excitation Speech Coder," *Proceedings IEEE International Conference on Acoustics, Speech, and Signal Processing* ICASSP'88, pp. 374–377, New York 1988, (describes a speech coder that uses redundancies into more efficiently quantize the speech parameters);

4. Daniel W. Griffin and Jae S. Lim, "A New Pitch Detection Algorithm," *Digital Signal Processing* '84, Elsevier Science Publishers, 1984, pp. 395–399, (describes an approach to pitch detection in which the pitch period and spectral envelope are estimated by minimizing a least squares error criterion between the synthetic spectrum and the original spectrum);

5. Daniel W. Griffin and Jae S. Lim, "a New Model-Based Speech Analysis/Synthesis System," *Proceedings IEEE International Conference on Acoustics, Speech, and Signal Processing* ICASSP'85, 1985, pp. 513–516 (describes the implementation of a model-based speech analysis/synthesis system where the short time spectrum of speech is modeled as an excitation spectrum and a spectral envelope);

6. Robert J. McAulay and Thomas F. Quatieri, "Mid-Rate Coding Based On A Sinusoidal Representation of Speech," *Proceedings IEEE International Conference on Acoustics, Speech, and Signal Processing* ICASSP'85, 1985, pp. 945–948 (describes a sinusoidal model to describe the speech waveform using the amplitudes, frequencies, and phases of the component sine waves);

7. Robert J. McAulay and Thomas F. Quatieri, "Computationally Efficient Sine Wave Synthesis And Its Application to Sinusoidal Transform Coding," *Proceedings IEEE International Conference on Acoustics, Speech, and Signal Processing* ICASSP'88, 1988, pp. 370–373, (describes a technique to synthesize speech using sinusoidal descriptions of the speech signal while relieving the computational complexity inherent in the technique);

8. Xiaoshu Qian and Randas Kumareson, "A variable Frame Pitch Estimator and Test Results," *Proceedings IEEE International Conference on Acoustics, Speech, and Signal Processing* ICASSP'96, 1996, pp. 228–231, (describes a new algorithm to identify voiced sections in a speech waveform and determine their pitch contours); and 9. Ma Wei, "Multiband Excitation Based Vocoders and Their Real-Time Implementation", Dissertation, University of Surrey, Guildford, Surrey, U.K. May 1994, pp. 145–150 (describes vocoder analysis and implementations).

In vocoder applications, the prior art has demonstrated complicated methods to estimate the pitch of an acoustic input signals. One method of improving pitch estimation has been to improve the resolution by using half samples, quarter samples, or even finer sampling. The finer sampling increase the complexity of the implementation of the pitch estimation significantly.

Pitch estimation in fractional sample intervals has been successful in waveform and hybrid coding schemes, since it improves the speech quality in the sense of waveform similarity. However, vocoders do not necessarily need accurate pitch since a waveform based distortion is not valid in a vocoder. The reason that high resolution pitch estimation is used within a vocoder is to remove the effects of pitch doubling. Pitch doubling is an error condition where the estimation technique selects a pitch that is twice that of the correct pitch.

U.S. Pat. No. 5,226,108 (Hardwick et al.) discloses a pitch estimation method where sub-integer resolution values are estimated in making the initial pitch estimate. An error function is minimized in the pitch selection, with a forward tracking and backward tracking method being employed to prevent the pitch doubling phenomena. The text explaining the background of the invention details the state of the prior art in the analysis and synthesis of acoustical signals. The content of U.S. Pat. No. 5,226,108 is incorporated herein by reference.

U.S. Pat. No. 5,495,555 (Swaninathan) discloses a technique for high quality low bit rate speech coding and decoding employing a codebook excited linear prediction technique.

SUMMARY OF THE INVENTION

An object of this invention is to provide a method for the high quality estimation of pitch within a sampling of acoustical signals while reducing complexity.

Further another object of this invention is the minimization of an error function in the estimation of the pitch.

Still another object of this invention is the minimizing of effects of erroneous selection of pitches that are double or half the correct pitch.

To accomplish these and other objects, a method for the estimation of pitch within acoustical signals begins with the center clipping of the acoustical signals to eliminate formants from the acoustic signals. The acoustic signal is then low-pass filtered to eliminate any residual formants. From the filtered acoustical signal an error function for each pitch is calculated. The appropriate pitch is selected by a fast tracking method to minimize the error function. A final checking of the selected pitch for a pitch doubling is performed.

DETAILED DESCRIPTION OF THE INVENTION

Figure 1:
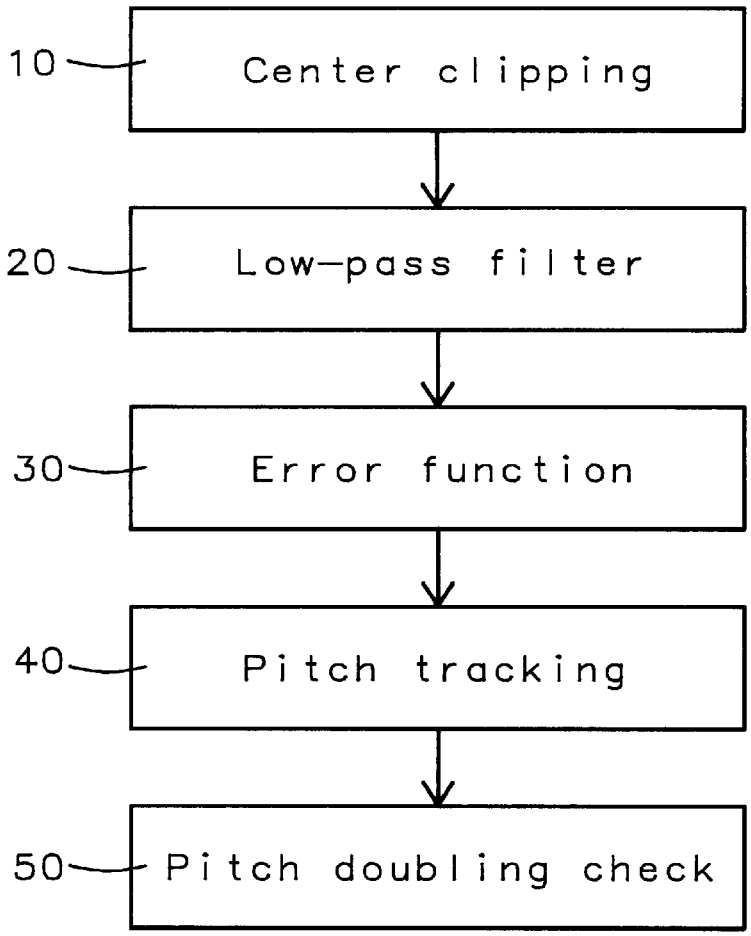
FIG. 1 is a flow chart of the method for the pitch estimation of this invention.

Referring to FIG. 1, center clipping 10 takes place after the speech or acoustic signal has been sampled in time and the sample is digitized. A set of samples are grouped in a window of time and then converted to the component frequencies. The component frequencies of the speech or acoustic signals are center clipped 10 to remove formant frequencies from the speech or acoustic signal that may be confounded with the pitch frequencies.

Any residual formants will be removed by low-pass filtering 20 of the speech or acoustic signals. The order of the center clipping 10 and the low pass filtering 20 in the process of pitch estimation may be exchanged. Next the error function for all candidate pitches are calculated 30 as:

$$E(p) = 1 - \left[\frac{R_{xy}(p)|R_{xy}(p)|}{R_{xx}(p)R_{yy}(p)}\right] \quad \text{eq. 1}$$

where $$R_{xx}(p) = \sum_{n=0}^{p-1} x_p(n)x_p(n) \quad \text{eq. 2a}$$

$$R_{yy}(p) = \sum_{n=0}^{p-1} y_p(n)y_p(n) \quad \text{eq. 2b}$$

$$R_{xy}(p) = \sum_{n=0}^{p-1} x_p(n)y_p(n) \quad \text{eq. 2c}$$

$$x_p(n) = s(n)W_p(n) \quad \text{eq. 3}$$

$$y_p(n) = s(n+p)W_p(n) \quad \text{eq. 4}$$

$W_p$ is a rectangular windowing function and is $$w_p(n) = \begin{cases} 1 & 0 \le n < p \\ 0 & \text{otherwise} \end{cases} \quad \text{eq. 5}$$

s(n) is the speech or acoustic signal.

s(n+p) is the speech or acoustic signal delay by p samples.

$R_{xx}$ and $R_{xx}$ are autocorrelation functions for x and y.

$R_{xy}$ is a cross correlation function for x and y.

The error function as described in eq. 1 is based upon a variable window length and biased to high pitch frequency which will inherently remove pitch doubling effects. The window length will be p samples in length and will vary from 2 mSec.–20 mSec.

Pitch halving is removed by the incorporation of the cross correlation function multiplied by the absolute value of the cross correlation function $R_{xy}(p)|R_{xy}(p)|$. The pitch doubling effect happens because the error function is minimized not only for the fundamental pitch frequency but also for the harmonics of the pitch frequency. The second harmonic of the pitch frequency (pitch doubling) will have the least error and the most likelihood of being selected. The pitch halving is effect is similar to pitch doubling except the pitch frequency chosen is at half the fundamental pitch frequency.

Figure 2:
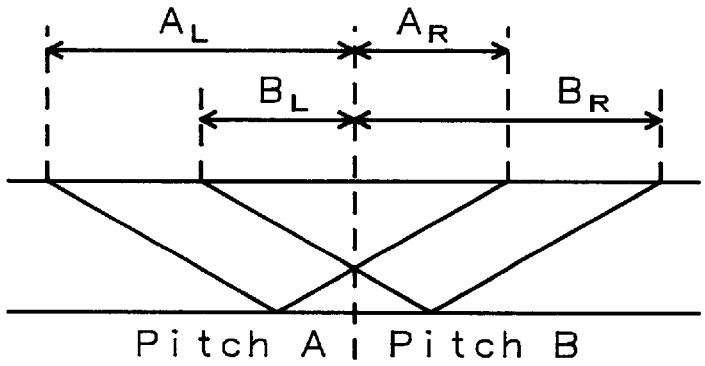
FIG. 2 is a diagram of the fast tracking method for pitch selection of this invention.

The pitch frequency of the speech or acoustic signal is selected 40 according to a pitch tracking method. FIG. 2 shows a diagram of the fast tracking method. for the pitch selection.

The detailed pitch tracking scheme has been described in U.S. Pat. No. 5,226,108 (Hardwick, et al.), in which a dynamic programming method is used. The dynamic programming method involves a complicated, computationally intensive look ahead/look backward process, where as this invention incorporates an accurate fast search method within the look ahead/look backward process. A and B are both candidate pitch values for the current frame, the selection for the correct pitch is based on the minimum cost of a combined cost function which is the summation of the error function for the candidate pitch minimum errors around the candidate values, such as a−5, a−4, . . . , A+5, in neighboring time slots or frames, say 20 mSec later or earlier.

For example $$C(t,A)=E(t,A)+\text{Min}\{E(t+T_f,a),a=A-k,A-k+1, \ldots ,A+k\}$$

$$C(t,B)=E(t,B)+\text{Min}\{E(t+T_f,b),b=B-k,B-k+1, \ldots ,B+k\}$$

where:

t=the current time.

$T_f$=frame length, normally 10–30 msec.

k=track range, in the above example k=5, the typical value would be k=0.2 P, where P is the candidate pitch value and would be A or B in the above equations respectively. For example, k=20 if pitch to be searched is 100 samples.

C(t,A)=current cost function for candidate pitch A.

C(t,B)=current cost function for candidate pitch B

E(t,A)=current error function for candidate pitch A as defined in eq. 1.

E(t,B)=current error function for candidate pitch B as defined in eq. 1.

$E(t+T_f,a)$=next frame error function for candidate pitch a as defined in eq. 1.

$E(t+T_f,b)$=next frame error function for candidate pitch b as defined in eq. 1.

Min $\{E(t+T_f,a)$, a=A−5, A−4, . . . , A+5$\}$=the minimum $E(t+T_f,a)$ among the possible a.

Min $\{E(t+T_f,b)$, a=B−5, B−4, . . . , B+5$\}$=the minimum $E(t+T_f,b)$ among the possible b.

As the procedure of finding the Min $\{E(t+T_f,a)$, a=A−5, A−4, . . . , A+5$\}$ is a kind of search process. It occupies the most computation time in the pitch determination process. The invention takes advantage of overlapped search ranges and divides every search range into two sub-ranges: the left search range—$A_L$ and $B_L$, and the right search range—$A_R$ and $B_R$. Two searches left and right search, can find all minimum values for all overlapped ranges which significantly reduces the complexity.

Returning to FIG. 1, the selected pitch is then rechecked 50 for pitch doubling. Even though the structure of Eq. 1 is such that the pitch doubling is nearly eliminated, the irregularity of speech or acoustical signals will necessitate a final check for pitch doubling.

The pitch doubling check is accomplished in two stages:

Stage 1:

If E(Psub)<α and

If E(Psub)<βE(P)

then E(Psub) is valid else E(P) is valid where

E(P) is the above described error function for the pitch p.

E(Psub) is the above described error function for submultiples of the pitch p.

Psub=p/k where k=2,3,4, . . .

α and β are system dependent constants related to window size and the tracking scheme and can be determined experimentally.

Stage 2:

The check is to use the forward and backward pitch tracking:

if ((Pb+m/2)/m)==((Pf+n/2)n) and E(Pb)<a then Pf=Pb
if ((Pf+m/2)/m)==((Pb+n/2)n) and E(Pf)<a then Pb=Pf
where
m=4
n=8,12,16,20
Pf is the estimated pitch from the next windowed sample of the acoustic signal
Pb is the estimated pitch from the previous windowed sample of the acoustic signal.

As an illustration, if it is assumed that $\alpha$=0.8 and $\beta$=1.8 and P=100 samples and Psub=50 samples, E(P)=0.4 and E(Psub)=0.7, then even though E(Psub) is not the global minimum Psub is chosen since it meets all the above conditions.

The estimated pitch will be combined with voiced/unvoiced decisions of the windowed sampling of the speech or acoustic signal and the energy description of the spectrum of the speech or acoustic signal, and retained for further processing or transmitted within a digital communications network.

It will be apparent to those skilled in the art, the above described method maybe implemented as a program within a general purpose computing system or a digital signal processing system and in fact may be designed with special purpose electronic circuitry.

While this invention has been particularly shown and described with reference to the preferred embodiments thereof, it will be understood by those skilled in the art that various changes in form and details may be made without departing from the spirit and scope of the invention.

What is claimed is:

1. A method for estimation of pitch of an input acoustic signal within a vocoder analyzer to minimize distortion within a vocoder synthesizer while reducing the complexity of said estimation of pitch, comprising the steps of:

a) center clipping of said input acoustic signals to remove a plurality of formants from said input acoustic signal to form a center clipped acoustic signal;

b) low-pass filtering of the center clipped acoustic signal to further remove any residual of the plurality of formants from said center clipped acoustic signal to form a filtered acoustic signal;

c) calculating an error function for each pitch within said filtered acoustic signals, wherein said error function is determined by the following equation:

$$E(p) = 1 - \left[\frac{R_{xy}(p)|R_{xy}(p)|}{R_{xx}(p)R_{yy}(p)}\right]$$

where $$R_{xx}(p) = \sum_{n=0}^{p-1} x_p(n)x_p(n)$$

$$R_{yy}(p) = \sum_{n=0}^{p-1} y_p(n)y_p(n)$$

$$R_{xy}(p) = \sum_{n=0}^{p-1} x_p(n)y_p(n)$$

$$x_p(n) = s(n)W_p(n)$$

$$y_p(n) = s(n+p)W_p(n)$$

$W_p$ is a rectangular windowing function and is $$w_p(n) = \begin{cases} 1 & 0 \le n < p \\ 0 & \text{otherwise} \end{cases}$$

s(n) is the speech or acoustic signal,
s(n+p) is the speech or acoustic signal delayed by p samples,
$R_{xx}$ and $R_{xx}$ are autocorrelation functions for x and y,
$R_{xy}$ is a cross correlation function for x and y; and d) selecting of said pitch so as to minimize said error function.

2. The method of claim 1 wherein the selecting of the pitch comprises the steps of:

a) dividing an overlapped search range of pitches into a left sub-range and a right sub-range;

b) scanning said left sub-range for minimum pitch error;

c) scanning said right sub-range for minimum pitch error; and d) selecting the pitch with minimum pitch error.

3. The method of claim 1 further comprising the step of checking said selected pitch for a pitch doubling.

4. The method of claim 3 wherein said checking comprises the steps of:

a) checking if a submultiple of the selected pitch is valid alternative for the selected pitch according to the following:
If E(Psub)<$\alpha$ and
If E(Psub)<$\beta$E(P)
then E(Psub) is valid
else E(P) is valid
where
is the error function for the pitch p,
E(Psub) is the above described error function for submultiples of the pitch p,
Psub=p/k where k=2,3,4, . . .
and $\beta$ are system dependent constants related to window size and the tracking scheme and can be determined experimentally; and b) checking for said pitch doubling between a forward tracking and a backward tracking wherein:
if ((Pb+m/2)/m)==((Pf+n/2)n) and E(Pb)<a then Pf=Pb
if ((Pf+m/2)/m)==((Pb+n/2)n) and E(Pf)<a then Pb=Pf
where
m=4
n=8,12,16,20
Pf is the estimated pitch from the next windowed sample of the acoustic signal
Pb is the estimated pitch from the previous windowed sample of the acoustic signal.

5. A pitch estimation means within a vocoder analyzer to estimate pitch of an input acoustic signal comprising:

a) a center clipping means to remove a plurality of formants from said input acoustic signal to form a center clipped acoustic signal;

b) a low-pass filtering means to further remove any residual of the plurality of formants from said center clipped acoustic signal to form a filtered acoustic signal;

c) an error function calculating means for determining an error function for each pitch within said filtered acoustic signals, wherein said error function is determined by the following equation:

$$E(p) = 1 - \left[ \frac{R_{xy}(p)|R_{xy}(p)|}{R_{xx}(p)R_{yy}(p)} \right]$$

where $$R_{xx}(p) = \sum_{n=0}^{p-1} x_p(n)x_p(n)$$

$$R_{yy}(p) = \sum_{n=0}^{p-1} y_p(n)y_p(n)$$

$$R_{xy}(p) = \sum_{n=0}^{p-1} x_p(n)y_p(n)$$

$$x_p(n) = s(n)W_p(n)$$

$$y_p(n) = s(n+p)W_p(n)$$

$W_p$ is a rectangular windowing function and is $$w_p(n) = \begin{cases} 1 & 0 \le n < p \\ 0 & \text{otherwise} \end{cases} \quad \text{eq. 5}$$

s(n) is the speech or acoustic signal, s(n+p) is the speech or acoustic signal delayed by p samples, $R_{xx}$ and $R_{xx}$ are autocorrelation functions for x and y, $R_{xy}$ is a cross correlation function for x and y; and d) a pitch selecting means to select pitch of said filtered acoustic signal so as to minimize said error function.

6. The pitch estimation means of claim 5 wherein the selecting of the pitch comprises the steps of:

a) dividing an overlapped search range of pitches into a left sub-range and a right sub-range;

b) scanning said left sub-range for minimum pitch error;

c) scanning said right sub-range for minimum pitch error; and d) selecting the pitch with minimum pitch error.

7. The pitch estimation means of claim 5 further comprising a pitch doubling checking means to check said selected pitch for a pitch doubling.

8. The pitch estimation means of claim 7 wherein said check comprises the steps of:

a) checking if a submultiple of the selected pitch is valid alternative for the selected pitch according to the following:

If E(Psub)<α and

If E(Psub)<βE(P)

then E(Psub) is valid else E(P) is valid where is the error function for the pitch p, E(Psub) is the above described error function for submultiples of the pitch p, Psub=p/k where k=2,3,4, . . .

and β are system dependent constants related to window size and the tracking scheme and can be determined experimentally; and b) checking for said pitch doubling between a forward tracking and a backward tracking wherein:

if ((Pb+m/2)/m)==((Pf+n/2)n) and E(Pb)<a then Pf=Pb if ((Pf+m/2)/m)==((Pb+n/2)n) and E(Pf)<a then Pb=Pf where m=4 n=8,12,16,20

Pf is the estimated pitch from the next windowed sample of the acoustic signal

Pb is the estimated pitch from the previous windowed sample of the acoustic signal.

* * * * *